US005829830A

United States Patent [19]

Maloney

[11] Patent Number: 5,829,830

[45] Date of Patent: Nov. 3, 1998

[54] SUPPORT INSERT FOR A HIGHCHAIR

[75] Inventor: Kevin V. Maloney, North Kingston, R.I.

[73] Assignee: Hasbro, Inc., Pawtucket, R.I.

[21] Appl. No.: 846,871

[22] Filed: May 1, 1997

[51] Int. Cl.[6] ..... A47C 7/02

[52] U.S. Cl. ..... 297/230.13; 297/230.1; 297/219.12; 297/230.12; 297/230.14; 297/440.12; 297/153; 5/655

[58] Field of Search ..... 297/230.13, 230.1, 297/230.12, 230.14, 219.12, 221, 223, 440.12, 153; 5/655

[56] References Cited

U.S. PATENT DOCUMENTS

| | | | |
|---|---|---|---|
| D. 328,196 | 7/1992 | Takahashi et al. . | |
| 1,673,433 | 6/1928 | Wheeler et al. | 297/230.13 |
| 2,621,714 | 12/1952 | Kivad | 297/230.13 X |
| 2,855,986 | 10/1958 | Engelen, Sr. | 297/230.1 X |
| 2,940,511 | 6/1960 | Gome | 297/440.12 |
| 2,960,149 | 11/1960 | Throssel | 297/440.12 |
| 3,189,381 | 6/1965 | Heidt et al. | 297/230.1 |
| 3,506,301 | 4/1970 | Van Santen | 297/230.1 X |
| 3,542,421 | 11/1970 | Ambrose | 297/230.12 |
| 3,720,441 | 3/1973 | Corchran | 297/230.12 |
| 4,362,334 | 12/1982 | Ross et al. | 297/230.12 |
| 4,383,713 | 5/1983 | Roston | 297/219.12 X |
| 4,603,903 | 8/1986 | Maloney . | |
| 4,634,176 | 1/1987 | Scott | 297/230.13 X |
| 4,679,848 | 7/1987 | Spierings | 297/230.14 |
| 4,695,092 | 9/1987 | Hittie | 297/219.12 |
| 4,752,982 | 6/1988 | Jones et al. | 297/230.14 X |
| 4,783,865 | 11/1988 | Stotler | 5/655 X |
| 4,793,652 | 12/1988 | Hannah et al. | 297/230.14 |
| 4,891,454 | 1/1990 | Perdelwitz, Jr. et al. . | |
| 4,892,357 | 1/1990 | Nieto-Busby et al. . | |
| 5,216,772 | 6/1993 | Clute | 5/655 |
| 5,228,745 | 7/1993 | Hazel . | |
| 5,310,245 | 5/1994 | Lyszczasz | 297/219.12 |
| 5,423,098 | 6/1995 | Swezey et al. | 297/440.12 X |
| 5,441,328 | 8/1995 | Snyder . | |
| 5,486,037 | 1/1996 | Harper . | |
| 5,507,550 | 4/1996 | Moloney | 297/153 |
| 5,507,551 | 4/1996 | Barry . | |
| 5,551,749 | 9/1996 | Reher et al. | 297/219.12 |

*Primary Examiner*—Peter M. Cuomo
*Assistant Examiner*—Rodney B. White
*Attorney, Agent, or Firm*—Kurt R. Benson

[57] ABSTRACT

A highchair includes a chair assembly, a frame assembly supporting the chair assembly above a supporting surface, and a removable support insert for positioning and supporting the upper torso of an infant seated in the highchair. The chair assembly includes a seat portion, a back rest portion, and opposing side arm rest portions which all cooperate to support a child seated in the chair assembly. The removable torso support includes a generally planar center portion, and a pair of side portions which are integrally attached to the side edges of the center portion along living hinges. Each of the side portions includes an inner segment and outer segment which are rigidly connected in angular relation. The insert can be positioned in an operative position on the chair assembly wherein the center portion is secured to the lower back rest portion of the chair. The inner and outer segments of the side portions are angularly oriented such that when the center portion of the support is received against the back rest portion of the chair, the inner segments extend forwardly and outwardly and the outer segments extend further outwardly and engage with outer side edge portions of the back rest portion of the chair assembly to maintain the inner segments in an outwardly and forwardly extending position. The center portion and inner segments of the insert thereby cooperate to provide a narrowed nesting area for positioning and supporting the upper torso portion of an infant seated in the chair assembly. The insert is removable from the operative position for storage an inoperative position in a recess formed on the front surface of the back rest portion of the chair. The recess has a depth and peripheral outline which corresponds to the thickness and outline of the insert whereby the insert is received in flush mating relation in the recess on the back rest.

13 Claims, 7 Drawing Sheets

SUPPORT INSERT FOR A HIGHCHAIR

BACKGROUND AND SUMMARY OF THE INVENTION

The instant invention relates to an infant seat, such as a highchair, and more particularly to a support insert for positioning and supporting the upper torso of a small infant seated in the highchair.

Various types of inserts for supporting infants in chairs and bassinets have heretofore been known in the art. In this regard, the U.S. Patents to Takahashi et al U.S. Pat. No. D328,196; Perdelwitz, Jr. et al U.S. Pat. No. 4,891,454; Hittie U.S. Pat. No. 4,695,092; Harper No. 5,486,037; and Hazel U.S. Pat. No. 5,228,745 represent the closest prior art to the subject invention of which the applicant is aware. Each of the above-noted patents discloses in one form or another, a type of support structure for use in an infant or toddler seat. For example, Takahashi teaches planar side walls in a highchair, Perdelwitz and Hazel each respectively teach a protective insert for car seats, and Hittie and Harper each respectively teach padded car seat liners with side pads for adding support and increasing comfort. While each of the above-noted inserts is effective for its intended purpose, there appears to be a wholesale lack of any type of support insert for highchairs, and/or booster seats, which is operative for supporting the upper torso portion of an infant when the infant is seated in the chair.

Accordingly, the instant invention provides an improved highchair construction including a removable support insert for positioning and supporting the upper torso of an infant when seated in the highchair. The highchair includes a chair assembly, a frame assembly supporting the chair assembly above a supporting surface, and a removable support insert for positioning and supporting the upper torso of an infant seated in the chair assembly. More specifically, the chair assembly includes a seat portion, a back rest portion, and opposing side arm rest portions which cooperate to support a child seated in the chair assembly. The removable support insert includes a generally planar center portion, and a pair of side portions which are integrally attached to the side edges of the center portion along living hinges. Each of the side portions includes a generally planar inner segment and a generally planar outer segment which are rigidly connected in angled relation. The insert is positioned in an operative position on the chair wherein the planar center portion is secured to the lower back rest portion of the chair assembly. The inner and outer segments of the side portions are angularly oriented such that when the center portion of the support is received against the back rest portion of the chair, the inner segments extend forwardly and outwardly and the outer segments of the side portions extend further outwardly and engage with side portions of the chair. The inner segments are thereby maintained in a forwardly and outwardly extending position. The center portion and forwardly extending inner segments cooperate to provide a narrowed nesting area for positioning and supporting the upper torso portion of an infant seated in the chair assembly. The insert is removable from the operative position for storage in an inoperative position in a recess formed on the front surface of the back rest portion of the chair. The recess has a depth and peripheral outline which corresponds to the thickness and peripheral outline of the insert whereby the insert can be received in flush mating relation in the recess on the back rest. The insert thereby merges into the back rest to form a continuous surface. A cloth pad is secured to the inner surfaces of the chair assembly to protect the infant and hide the support insert from view. Interfitting snap formations are formed on the insert and on respective portions of the back rest to releasably secure the insert in the operative and storage positions. When the insert is received in the storage recess, the chair is usable in its normal and intended purpose for older infants and toddlers. The recess and covering pad effectively hide the insert from view. For use, the insert can be easily removed from its inoperative storage position, and installed in the operative position in seconds so that the highchair can be used for a younger infant.

Among the objects of the instant invention are: the provision of a support insert for positioning and supporting the upper torso portion of an infant when seated in a chair; the provision of such an insert including a center portion attachable to the back rest of the chair and opposing side portions which cooperate with the center portion to provide support when the insert is in an operative position; the provision of an infant seat including such an insert wherein the seat provides a storage area for storing the insert when not in use; the provision of a highchair including such an insert wherein the highchair provides a storage recess in the surface of the back rest of the chair for storing the insert when not in use.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
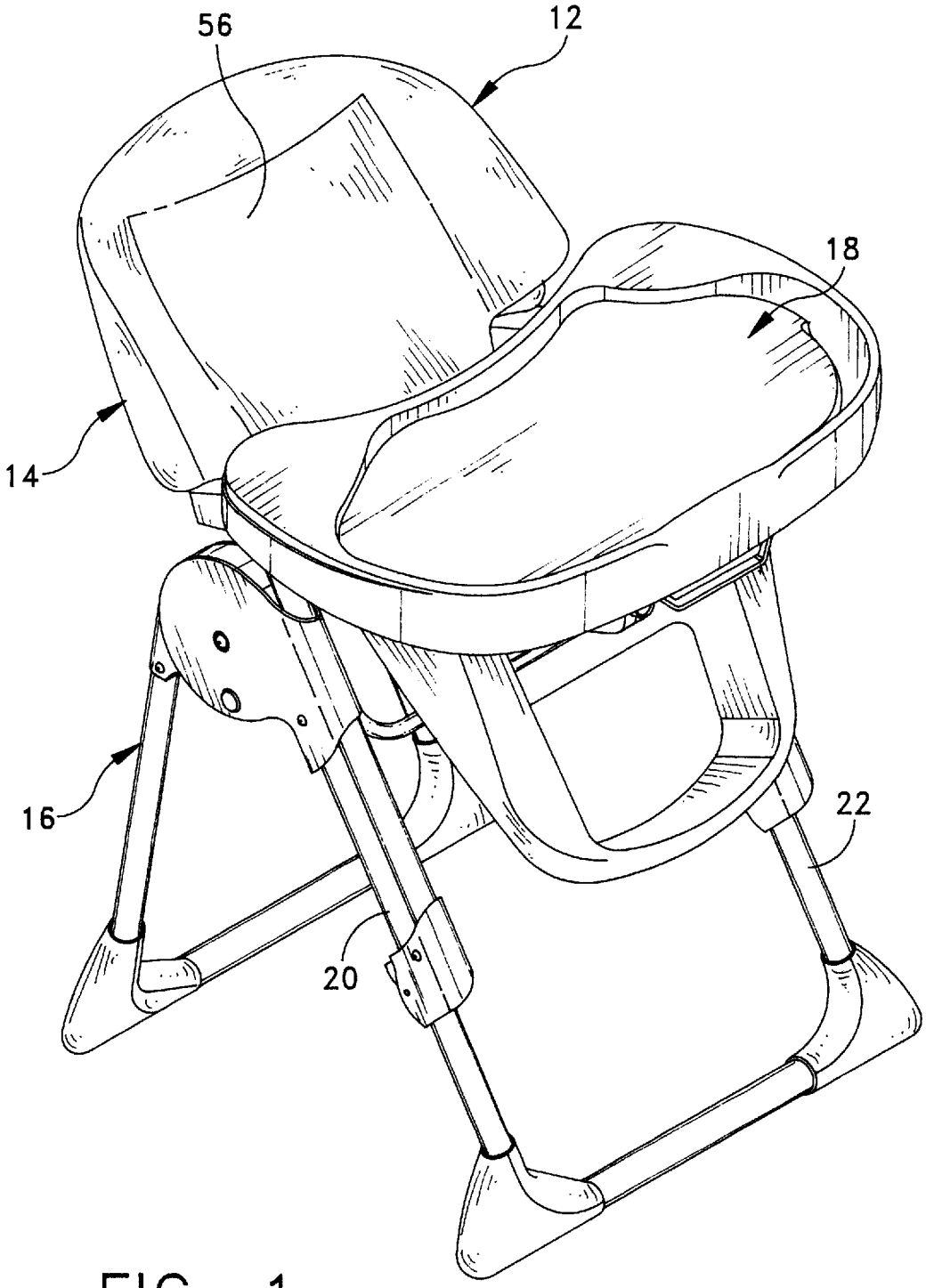
FIG. 1 is a perspective view of a highchair construction including the support insert in accordance with the present invention.

Referring now to the drawings, the support insert of the instant invention is illustrated and generally indicated at 10 in FIGS. 1–7. As will hereinafter be more fully described, the instant support insert is particularly useful in a highchair construction generally indicated at 12 wherein the insert 10 is operative for positioning and supporting the upper torso of an infant (not shown) when seated in the highchair 12. The highchair 12 can thereby be utilized for infants and small toddlers which are not yet able to fully support their upper torso and who would therefore not be normally able to utilize a normal full-size highchair.

The highchair construction 12 includes a chair assembly generally indicated at 14, a frame assembly generally indicated at 16 for supporting the chair assembly 14 above a supporting surface, and a tray portion 18 releasably attached to the chair assembly 14. The chair assembly 14 is mounted at the top of two spaced mounting arms 20, 22 which form part of the frame assembly 16. The chair assembly 14 includes a seat portion 24, a back rest portion 26, and opposing side arm rest portions 28, 30 which all cooperate to support a child seated in the chair assembly 14. The seat portion 24, back rest portion 26 and side arm rest portions 28, 30 are preferably molded from a plastic material and can be integrally formed as a single unit, or can be molded in several pieces and assembled together. The back rest portion includes a central planar area 32 and two side areas 34, 36 which angle slightly forwardly and outwardly. The tray portion 18 is releasably attached to a support 38 (FIG. 2) located in the center of the seat portion 24.

Figure 3:
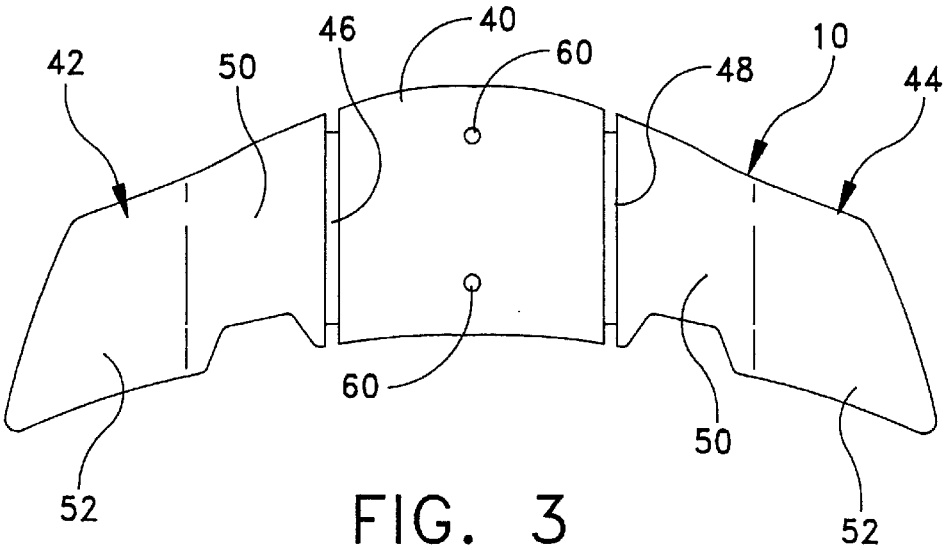
FIG. 3 is a front elevational view of the insert.
Figure 3A:
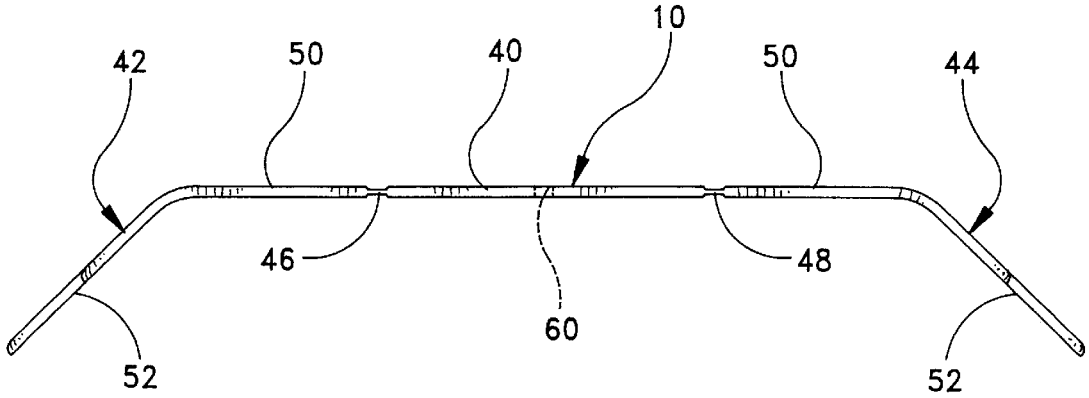
FIG. 3A is a top view of the insert in the inoperative position.
Figure 3B:
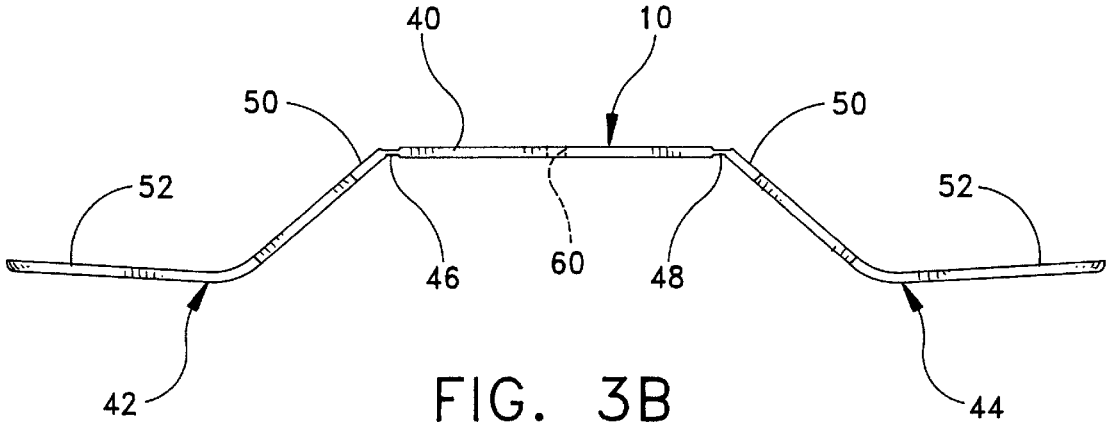
FIG. 3B is a top view of the insert in the operative position.

Referring to FIGS. 3, 3A and 3B, the removable support insert 10 includes a generally planar center portion 40, and a pair of side portions generally indicated 42, 44 which are integrally attached to the side edges of the center portion 40 along living hinges 46, 48. In this regard, the preferred material for forming the insert 10 is a plastic material, or other suitable material which can be molded with living hinges. Each of the side portions 42, 44 includes a generally planar inner segment 50 and a generally planar outer segment 52 which are rigidly connected in angled relation (See FIGS. 3A and 3B).

Figure 2:
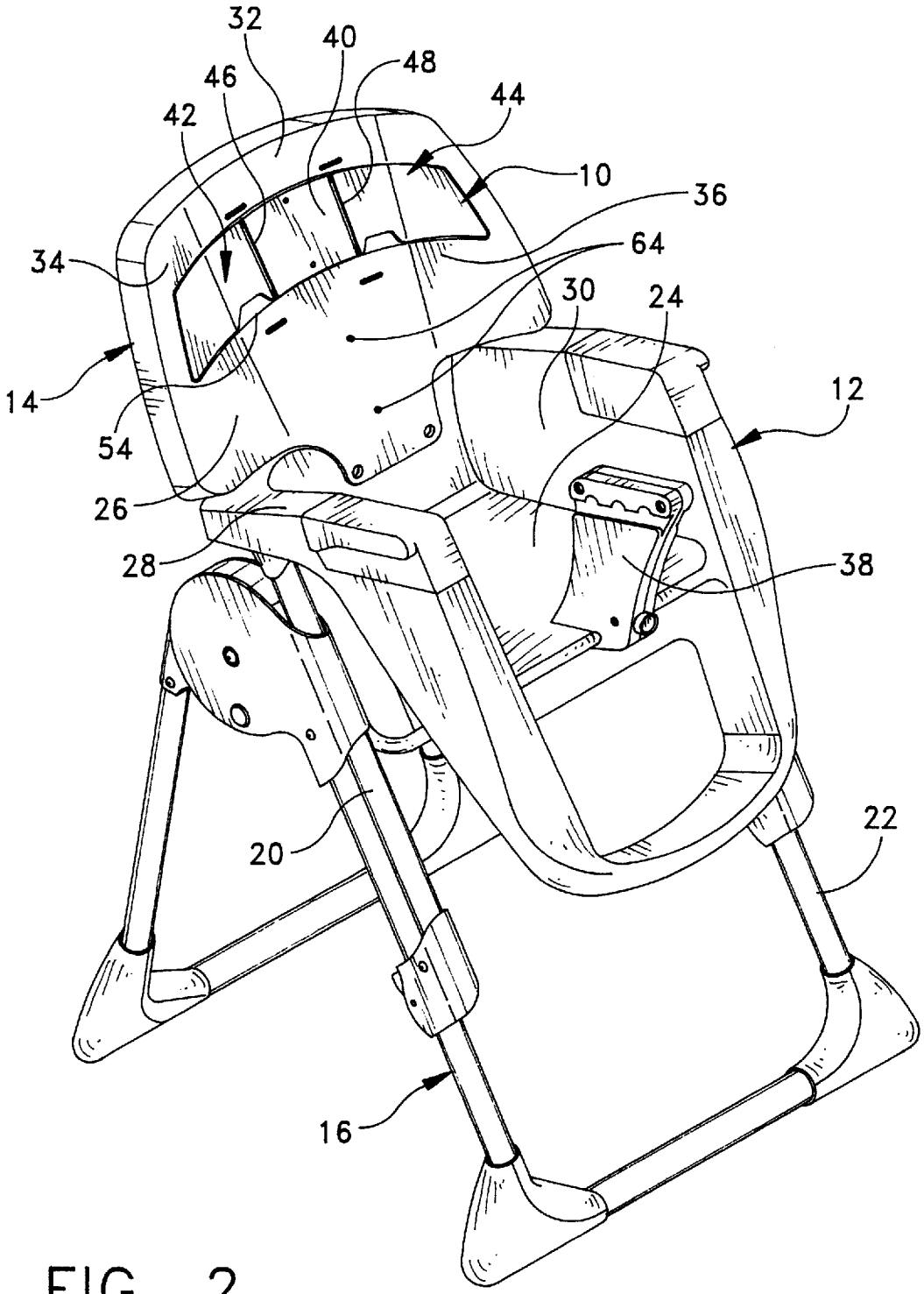
FIG. 2 is another perspective view with the padding removed to more clearly illustrate the insert which is concealed in a storage recess.
Figure 4:
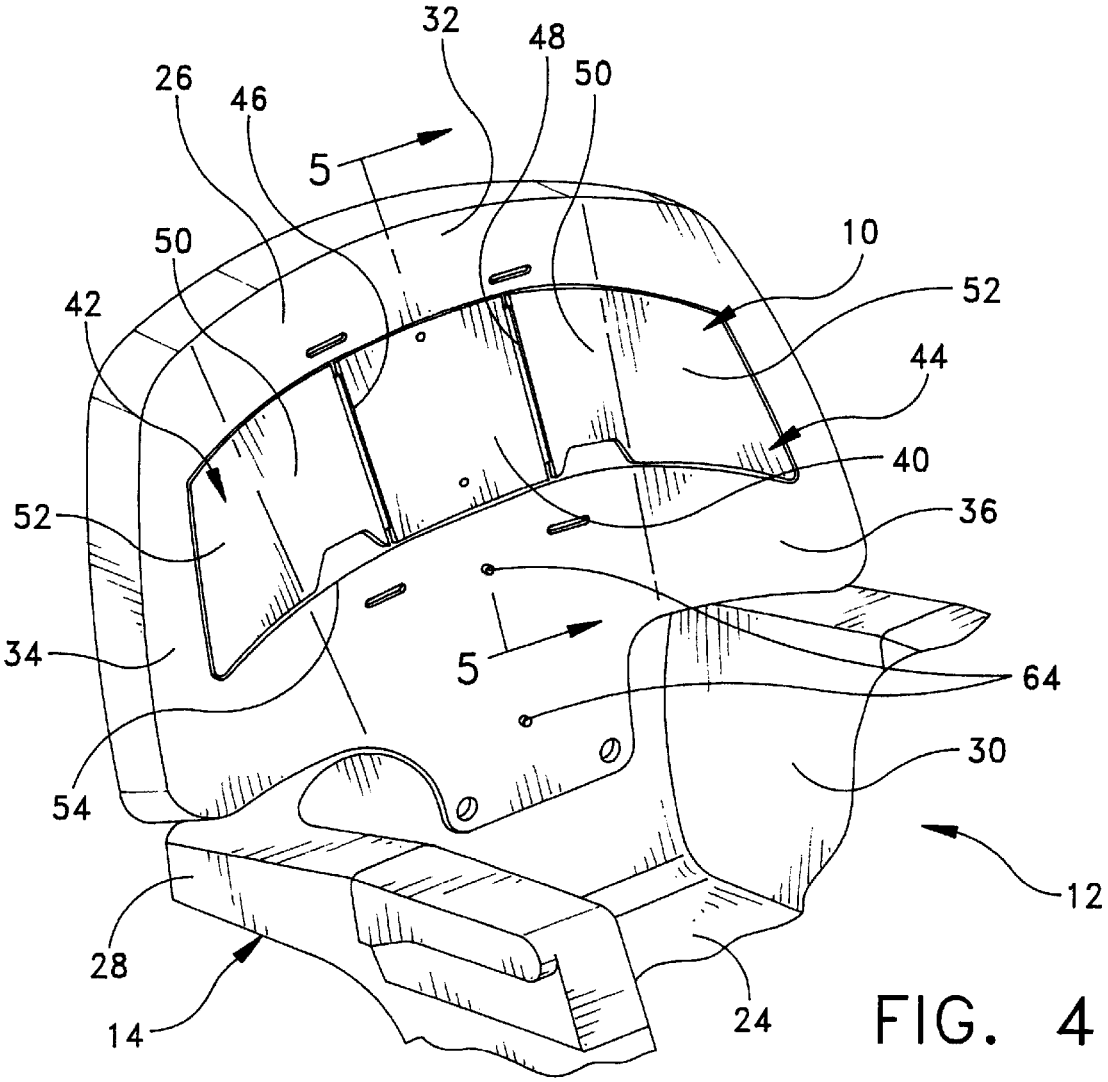
FIG. 4 is an enlarged fragmentary perspective view of the chair portion of the highchair showing the insert positioned in the storage recess.
Figure 5:
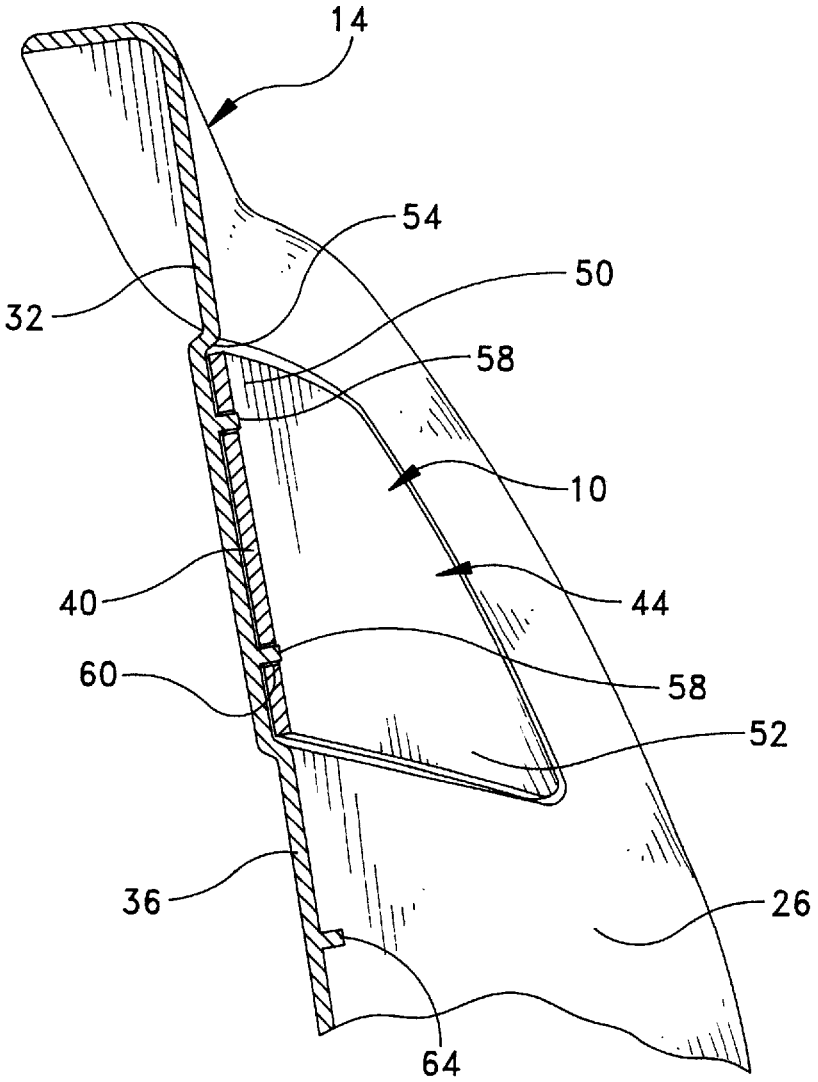
FIG. 5 is a cross-sectional view of the insert as taken along line 5—5 of FIG. 4.

Referring to FIGS. 4 and 5, the insert 10 is normally stored in an inoperative position in a recess 54 formed on the front surface of the back rest portion 26 of the chair 14. The recess 54 has a depth and peripheral outline which correspond to the thickness and peripheral outline of the insert 10 whereby the insert 10 can be received in flush mating relation in the recess 54 (FIGS. 2 and 4). The insert 10 thereby merges into the surface of the back rest 26 to form a continuous surface. A cloth pad 56 (FIG. 1) is secured to the inner surfaces of the chair assembly 14 portion to protect the infant and to hide the insert 10 from view. Interfitting snap formations, namely aligned pairs of posts 58 and apertures 60, are respectively formed in the recess 54 on the back rest 26 and in the insert 10 to releasably secure the insert 10 in the storage position. When the insert 10 is received in the storage recess 54, the chair 14 is usable in its normal and intended purpose for older infants and young toddlers. The recess 54 and covering pad 56 effectively hide the insert from view.

Figure 6:
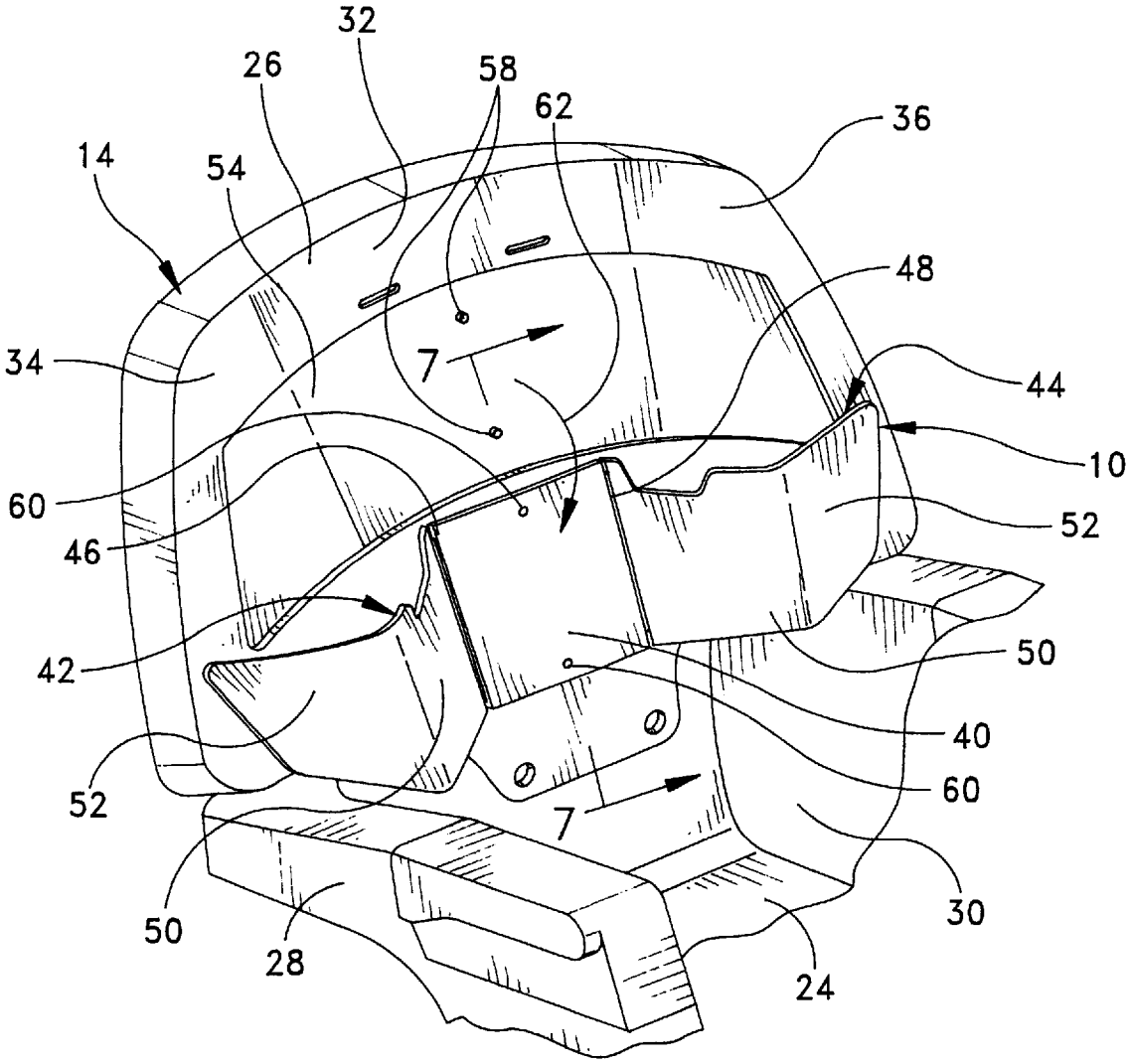
FIG. 6 is another enlarged fragmentary perspective view showing the insert in the operative position.
Figure 7:
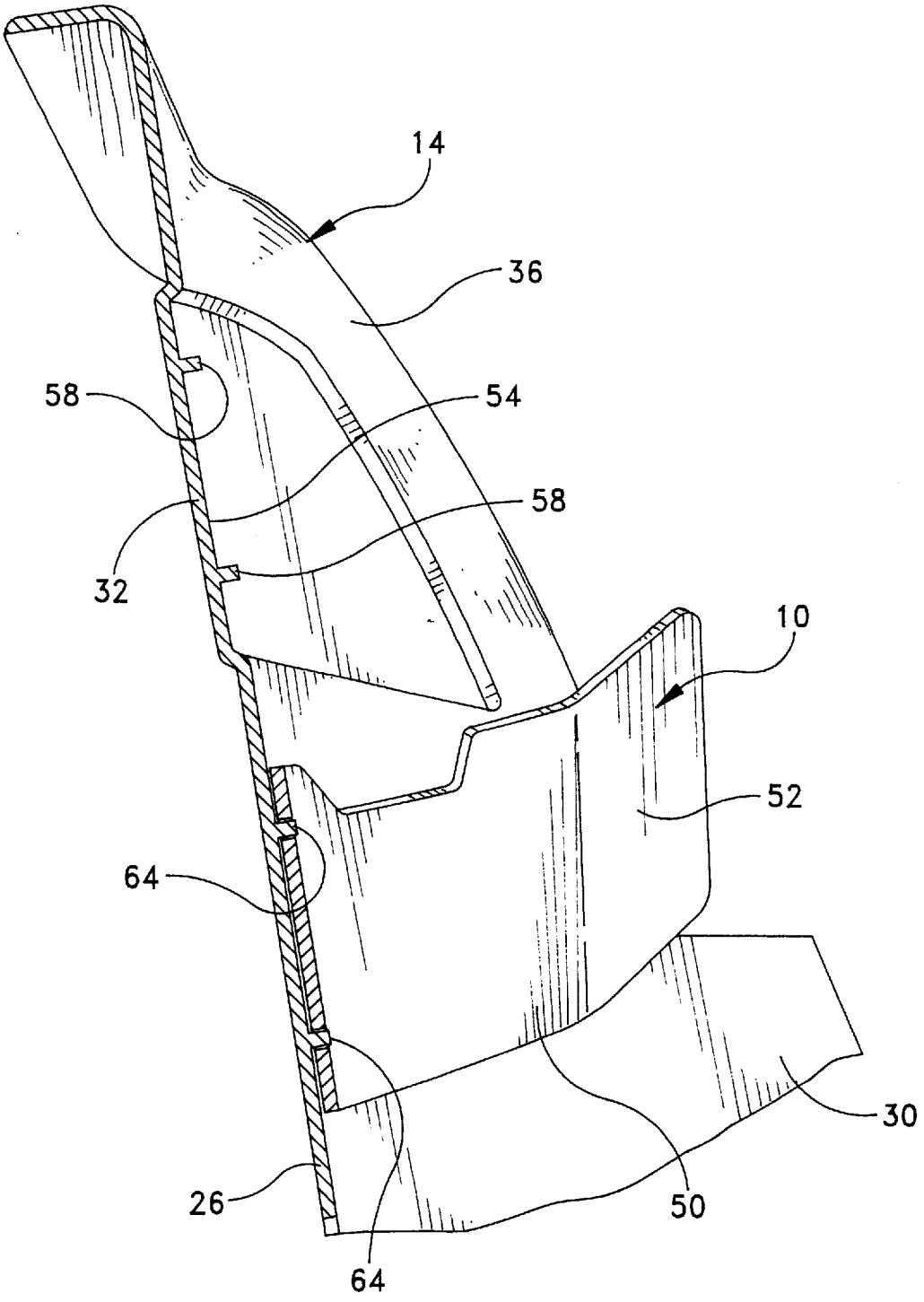
FIG. 7 is a cross-sectional view thereof taken along line 7—7 of FIG. 6.

Referring to FIGS. 6 and 7, the insert 10 is positioned in an operative position on the chair 14 wherein the planar center portion 40 is secured to the middle to lower area on the back rest portion 26 of the chair assembly 14. In this regard, it is pointed out to position that the insert 10 in the operative position it must turned over from the position illustrated in FIGS. 4 and 5, as indicated with direction arrow 62, so that the inner segments 50 extend angularly forwardly and outwardly and the outer segments 52 extend further outwardly. Referring to FIGS. 3A, 3B and 6, the inner and outer segments 50, 52 of the side portions 42, 44 are angularly oriented such that when the center portion 40 of the support 10 is received against the back rest portion 26 of the chair 14, the inner segments 50 extend forwardly and outwardly and the outer segments 52 extend further outwardly and engage with the side area portions 34, 36 of the back rest 26. The inner segments 50 are thereby maintained in an outwardly and forwardly extending position during use. The center portion 40 and inner segments 50 of the insert 10 thereby effectively cooperate to provide a narrowed nesting area (FIG. 6) for positioning and supporting the upper torso portion of an infant seated in the chair 14. It is noted that if the insert 10 was mounted in a position lower down on the back rest portion 26, the outer segments 52 would engage with the side arm rest portions 28, 30 to generally provide the same effect, although the nesting area would be narrower than illustrated in FIG. 6. Snap posts 64 are also formed on the lower portion of the back rest 26 to releasably secure the insert 10 in the operative position. The snap formations 58, 60 and 64 are positioned, and the configuration of the insert 10 is arranged such that the side portions 42, 44 of the insert 10 will support the upper torso portion of infant when seated. For use, the insert 10 can be easily removed from its inoperative storage position, and installed in the operative position in seconds so that the highchair 12 can be used for a younger infant.

It can therefore be seen that the present invention provides an effective support insert 10 for supporting a small infant in a regular size highchair of the type used for larger toddlers and young children. The side portions 42, 44 of the insert 10 effectively cooperate with the back rest 26 and side portions of the chair assembly 14 to provide proper positioning and support when installed in the chair assembly 14. The support insert 10 is configured and arranged with the back rest 26 of the chair assembly 14 such that the insert 10 can be concealed within a storage recess 54 when not and use, yet can be easily removed and installed in an operative position within seconds. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A support insert for positioning and supporting the upper torso of an infant seated in an infant chair wherein the infant chair is of a type including a backrest having a center portion and opposite side portions, said insert comprising:

a generally planar insert center portion which is receivable against the backrest center portion of the chair; and a pair of insert side portions which are hingeably connected to opposite side edges of said insert center portion, each of said insert side portions including an inner segment and an outer segment which are rigidly connected in angular relation, said inner and outer segments of said insert side portions being angularly oriented such that when the insert center portion is received against the backrest center portion of the chair, the inner segments extend forwardly and outwardly and the outer segments extend further outwardly and engage the chair to thereby maintain the inner segments in forwardly and outwardly extending positions, said insert center portion and said inner segments cooperating to provide a narrowed nesting area for positioning and supporting the upper torso portion of an infant seated in the infant chair.

2. The support insert of claim 1 further comprising means for releasably securing the support insert in the operative position on the infant chair.

3. The support insert of claim 2 wherein said means for securing comprises at least one securing element for releasably securing the insert center portion to the backrest center portion of the chair.

4. The support insert of claim 2 wherein said means for releasably securing the support insert includes a plurality of interfitting snap elements for mounting said insert to the backrest center portion of the chair.

5. The support insert of claim 1 wherein the side portions of the backrest of the chair angle outwardly and forwardly, the outer segments of said insert side portions engaging the side portions of the backrest of the chair.

6. A chair assembly for use by infants and young children comprising:

a chair including a seat and a backrest; and a removable support insert for positioning and supporting the upper torso of an infant seated on the seat of said chair, said insert comprising a generally planar center portion and a pair of said portions which are hingeably connected to opposite side edges of said center portion, each of said side portions including an inner segment and an outer segment which are rigidly connected in angular relation, said insert being removably positionable in an operative position on the chair wherein the center portion of the insert is received against a center portion of the backrest of the chair, said inner and outer segments of said insert side portions being angularly oriented such that when the center portion of the insert is received against the center portion of the backrest of the chair, the inner segments extend forwardly and outwardly and the outer segments extend further outwardly and engage the chair to thereby maintain the inner segments in forwardly and outwardly extending positions, said center portion and said inner segments cooperating to provide a narrowed nesting area for positioning and supporting the upper torso portion of an infant seated in the chair assembly.

7. The chair assembly of claim 6 wherein said insert is removable from the operative position for storage in an inoperative position on the chair.

8. In the chair assembly of claim 7, said backrest having a storage recess formed in a front surface thereof for storage of said support insert in the inoperative position.

9. In the chair assembly of claim 8, said storage recess having a depth and peripheral outline which is complimentary to a thickness and peripheral outline of said insert, said insert being received in flush mating relation in said storage recess whereby the insert and the backrest of the chair cooperate to form a continuous surface.

10. The chair assembly of claim 9 further comprising means for releasably securing said insert within said storage recess.

11. The chair assembly of claim 8 further comprising means for releasably securing said insert in the operative position on the backrest of said chair.

12. The chair assembly of claim 11 wherein said means for releasably securing said support insert to the backrest of said chair includes a plurality of interfitting snap elements for mounting said insert on the backrest of said chair.

13. The chair assembly of claim 6 wherein the backrest of said chair includes side portions which angle outwardly and forwardly from said backrest center portion, the outer segments of said side portions of said insert engaging the side portions of the backrest of said chair.

* * * * *